US011421837B2

(12) United States Patent
Zhang et al.

(10) Patent No.: US 11,421,837 B2
(45) Date of Patent: Aug. 23, 2022

(54) SPOTLIGHT STRUCTURE

(71) Applicant: JIANGSU SUR LIGHTING CO., LTD., Yancheng (CN)

(72) Inventors: Haicheng Zhang, Acworth, GA (US); Honggui Xie, Nanjing (CN); Zhengen Li, Heze (CN)

(73) Assignee: JIANGSU SUR LIGHTING CO., LTD.

( * ) Notice: Subject to any disclaimer, the term of this patent is extended or adjusted under 35 U.S.C. 154(b) by 92 days.

(21) Appl. No.: 16/969,968

(22) PCT Filed: Apr. 30, 2020

(86) PCT No.: PCT/CN2020/088127
§ 371 (c)(1),
(2) Date: Aug. 13, 2020

(87) PCT Pub. No.: WO2021/212541
PCT Pub. Date: Oct. 28, 2021

(65) Prior Publication Data

US 2022/0082223 A1 Mar. 17, 2022

(30) Foreign Application Priority Data

Apr. 23, 2020 (CN) ..... 202010325182.5

(51) Int. Cl.
*F21S 8/08* (2006.01)
*B08B 3/02* (2006.01)
(Continued)

(52) U.S. Cl.
CPC ..... *F21S 8/081* (2013.01); *B08B 3/02* (2013.01); *F21V 31/005* (2013.01); *F21Y 2115/10* (2016.08)

(58) Field of Classification Search
CPC ... F21S 8/081; B08B 1/04; B08B 3/02; B08B 3/00; F21V 31/005
See application file for complete search history.

(56) References Cited

U.S. PATENT DOCUMENTS 2,668,901 A 2/1954 Austin
2,738,756 A 3/1956 Doane
(Continued)

FOREIGN PATENT DOCUMENTS

AT 445810 10/2009
CH 607571 8/1978
(Continued)

OTHER PUBLICATIONS

ANSI; Article entitled: "Degrees of Protection Provided by Enclosures (IP Code)", NEMA Standards Publication, Copyright 2004, 27 pgs.
(Continued)

*Primary Examiner* — Arman B Fallahkhair
(74) *Attorney, Agent, or Firm* — Taylor English Duma LLP

(57) ABSTRACT

A spotlight structure includes a main body, a waterproof front cover, and a waterproof rear cover. A front cavity and a rear cavity are arranged in the main body. A focusing component, a spotlight adjusting component and a color temperature adjusting component are arranged in the cavities. A screw thread is arranged on the outer walls of the front end and the rear end of the main body. A dovetail groove is arranged at the root of the screw thread. An O-ring is arranged on the dovetail groove. An edge of the waterproof front cover adjacent to the O-ring and an edge of the waterproof rear cover adjacent to the O-ring are a beveled edge, respectively. The waterproof front cover is threaded
(Continued)

with the front end of the main body, and the waterproof rear cover is threaded with the rear end of the main body.

5 Claims, 7 Drawing Sheets

(51) Int. Cl.
*F21V 31/00* (2006.01)
*F21Y 115/10* (2016.01)

(56) References Cited

U.S. PATENT DOCUMENTS 3,104,064 A 9/1963 Bellek
4,153,149 A 5/1979 Weber
4,186,851 A * 2/1980 Cantor ..... F21V 33/0076 222/113
4,495,463 A 1/1985 Milkovic
4,530,039 A * 7/1985 Shin-Shi ..... F21L 15/04 362/158
4,596,449 A 6/1986 Iwata et al.
4,739,457 A 4/1988 Orr
4,831,664 A 5/1989 Suda
4,853,722 A 8/1989 Gell, Jr.
4,963,798 A 10/1990 Mcdermott
5,161,883 A 11/1992 Gordin et al.
5,249,109 A 9/1993 Denison et al.
5,260,858 A * 11/1993 Maglica ..... F21L 4/005 362/205
5,319,959 A 6/1994 Cooper et al.
5,331,523 A * 7/1994 Delzer ..... F21V 33/0064 222/113
5,373,427 A * 12/1994 McLean ..... F21V 33/0064 222/113
5,420,766 A * 5/1995 Hollis ..... F21V 33/0064 222/113
5,454,611 A 10/1995 Wanat
5,513,085 A 4/1996 Bourne
5,584,568 A 12/1996 Corbasson et al.
5,825,308 A 10/1998 Rosenberg
5,826,971 A * 10/1998 Kibler ..... F21L 15/02 362/188
5,904,417 A 5/1999 Hewett
5,941,629 A * 8/1999 Tuscher ..... F21V 33/0076 362/253
D424,731 S 5/2000 Landefeld
6,092,914 A 7/2000 Esakoff et al.
6,113,252 A 9/2000 Arlitt et al.
6,161,948 A 12/2000 Hagen
6,290,368 B1 9/2001 Lehrer
6,361,183 B1 * 3/2002 Maglica ..... F21L 4/005 362/158
6,390,647 B1 5/2002 Shaefer
6,525,414 B2 2/2003 Shiraishi et al.
6,527,402 B1 * 3/2003 Borri ..... B65D 51/248 362/101
6,586,890 B2 7/2003 Min et al.
6,612,720 B1 * 9/2003 Beadle ..... F21V 17/02 362/287
6,633,110 B2 10/2003 Mcguire et al.
6,641,283 B1 11/2003 Bohler
6,652,113 B2 11/2003 Tant
6,676,270 B2 * 1/2004 Kostal ..... F41H 9/10 362/102
6,679,315 B2 1/2004 Cosley et al.
6,756,663 B2 6/2004 Shiraishi et al.
6,764,197 B1 7/2004 Zemar
6,806,659 B1 10/2004 Mueller et al.
6,874,910 B2 4/2005 Sugimoto et al.
6,883,941 B2 4/2005 Cutting
7,015,825 B2 3/2006 Callahan
7,038,399 B2 5/2006 Lys et al.
7,041,901 B2 5/2006 Case
7,084,353 B1 8/2006 Downes
7,109,668 B2 9/2006 Pogodayev et al.
7,160,001 B2 1/2007 Bartlett
7,163,313 B2 1/2007 Rosenberg
7,178,937 B2 2/2007 Mcdermott
7,192,162 B2 3/2007 Tanaka et al.
7,204,608 B2 4/2007 Beeman et al.
7,233,115 B2 6/2007 Lys
7,262,559 B2 8/2007 Tripathi
7,326,179 B1 2/2008 Cienfuegos
7,358,679 B2 4/2008 Lys et al.
7,445,365 B1 11/2008 Hsu
7,452,099 B2 11/2008 Evans et al.
7,513,661 B2 4/2009 Hamada et al.
7,534,975 B1 5/2009 Sarrah et al.
7,547,113 B2 6/2009 Lee
7,549,766 B2 6/2009 Sharrah et al.
7,625,101 B2 12/2009 Alessio
7,722,216 B2 5/2010 Amor et al.
7,733,659 B2 6/2010 Snider et al.
7,736,025 B2 6/2010 Hofmann et al.
7,738,235 B2 6/2010 Gloisten et al.
7,837,866 B2 11/2010 Burrows
7,847,486 B2 12/2010 Ng
7,872,259 B2 1/2011 Den et al.
7,874,717 B1 1/2011 Shaefer
7,896,524 B2 3/2011 Yoneda et al.
7,922,353 B2 4/2011 Isely
8,066,396 B2 11/2011 Hunt
8,070,328 B1 12/2011 Koble
8,096,674 B2 1/2012 Matthews et al.
8,138,690 B2 3/2012 Chemel et al.
8,148,912 B2 4/2012 Kim
8,162,502 B1 4/2012 Zadro
8,220,970 B1 7/2012 Khazi et al.
8,235,539 B2 8/2012 Thomas et al.
8,337,049 B2 12/2012 Shida et al.
8,403,530 B2 3/2013 Singer et al.
8,419,218 B2 4/2013 Dassanayake et al.
8,575,641 B2 11/2013 Zimmerman et al.
8,598,793 B2 12/2013 Yan et al.
8,632,196 B2 1/2014 Tong et al.
8,651,704 B1 2/2014 Gordin et al.
8,662,709 B2 3/2014 Chang
8,704,262 B2 4/2014 Livesay et al.
8,708,535 B2 4/2014 Dalsgaard
8,773,024 B2 7/2014 Yan et al.
8,827,512 B1 9/2014 Beadle
8,882,284 B2 11/2014 Tong et al.
8,905,587 B1 12/2014 Bouckaert
8,919,026 B2 12/2014 Hamilton
8,926,121 B2 * 1/2015 Wu ..... H05B 45/20 362/231
8,926,145 B2 1/2015 Lynch et al.
8,931,933 B2 1/2015 Tong et al.
8,936,472 B1 1/2015 Gibboney, Jr.
8,950,895 B2 2/2015 Vinther et al.
8,950,907 B2 2/2015 Packard et al.
8,967,497 B2 3/2015 Luettgen et al.
9,028,086 B2 5/2015 Woo et al.
9,062,830 B2 6/2015 Le et al.
9,115,857 B2 8/2015 Beausoleil
9,140,414 B1 9/2015 Beausoleil
9,140,431 B1 9/2015 Lee
9,168,495 B2 10/2015 Connors
9,169,997 B2 10/2015 Kurt et al.
9,175,814 B2 11/2015 Shida et al.
9,188,292 B2 * 11/2015 Armer ..... F21V 31/005
9,204,519 B2 12/2015 Gan et al.
9,206,964 B2 12/2015 Marsh et al.
9,207,484 B2 12/2015 Hendren et al.
9,210,733 B2 12/2015 Sargent et al.
9,234,655 B2 1/2016 Progl et al.
9,247,597 B2 1/2016 Miskin et al.
9,249,958 B2 2/2016 Schmuckle
9,258,103 B2 3/2016 Van De Ven et al.
9,285,103 B2 3/2016 Van De Ven et al.
9,285,109 B1 3/2016 Olsson et al.
9,306,139 B2 4/2016 Lee et al.
9,310,038 B2 4/2016 Athalye

(56) References Cited

U.S. PATENT DOCUMENTS 9,420,644 B1 8/2016 Shum
9,429,285 B2 8/2016 Shum
9,500,325 B2 11/2016 Tong et al.
9,598,575 B2 3/2017 Bhagwagar
9,614,322 B1 4/2017 Gibboney, Jr.
9,620,096 B2 4/2017 Ambrosino
9,657,930 B2 * 5/2017 Nolan ..... F21K 9/60
9,719,658 B2 8/2017 Maglica et al.
9,730,282 B2 8/2017 Munday et al.
9,739,440 B1 8/2017 Deyaf et al.
9,746,170 B1 * 8/2017 Armer ..... F21V 29/503
9,752,761 B2 9/2017 Lentine
9,777,915 B2 10/2017 Johnson
9,784,440 B2 * 10/2017 Erdener ..... H05B 47/25
9,806,458 B1 10/2017 Chiu et al.
9,863,622 B1 * 1/2018 Armer ..... F21V 7/0091
9,964,286 B1 5/2018 Sooferian
9,995,463 B2 6/2018 Kjeldsen et al.
10,036,535 B2 7/2018 Catalano
10,041,635 B2 * 8/2018 Lam ..... F21V 7/0075
10,113,735 B2 * 10/2018 Emerson ..... F21K 9/62
10,139,060 B1 11/2018 Erdener et al.
10,190,757 B2 1/2019 Erdener et al.
10,208,935 B2 2/2019 Erdener
10,240,758 B2 * 3/2019 Maglica ..... F21L 4/00
10,323,832 B2 6/2019 Erdener et al.
10,330,294 B2 6/2019 Erdener
10,357,146 B2 7/2019 Fiebel et al.
10,359,151 B2 7/2019 Tarsa et al.
10,465,864 B2 11/2019 Leichner
10,509,304 B2 12/2019 Chien
10,682,540 B2 6/2020 Mantione, III
10,704,745 B2 * 7/2020 Sherry ..... F21V 23/0414
10,760,773 B2 9/2020 Zhang
10,869,733 B2 12/2020 Learn
10,941,924 B2 * 3/2021 Yu ..... H05B 45/10
11,029,015 B1 6/2021 Olsson et al.
11,156,330 B2 * 10/2021 Grandadam ..... F21V 5/04
11,162,651 B2 11/2021 Zhang et al.
2004/0163797 A1 8/2004 Cosley et al.
2005/0007777 A1 1/2005 Klipstein et al.
2005/0135101 A1 6/2005 Richmond
2005/0174782 A1 8/2005 Chapman
2006/0187653 A1 8/2006 Olsson
2006/0262542 A1 11/2006 Ibbitson et al.
2007/0019415 A1 1/2007 Leblanc et al.
2007/0076415 A1 4/2007 Chou et al.
2007/0139913 A1 6/2007 Savage
2008/0083360 A1 4/2008 Rowley
2008/0123340 A1 5/2008 Mcclellan
2008/0080187 A1 11/2008 Moss et al.
2008/0273331 A1 11/2008 Moss et al.
2009/0073696 A1 3/2009 Melzner
2009/0205935 A1 8/2009 Frick
2010/0091485 A1 4/2010 Matthews et al.
2010/0127626 A1 5/2010 Altonen et al.
2010/0176750 A1 7/2010 West
2010/0226139 A1 9/2010 Lynch et al.
2010/0259200 A1 10/2010 Beausoleil
2011/0075404 A1 3/2011 Allen et al.
2011/0080741 A1 4/2011 Noh
2011/0121752 A1 5/2011 Newman, Jr. et al.
2011/0204777 A1 8/2011 Lenk
2012/0081901 A1 4/2012 Tsang
2012/0091900 A1 4/2012 Fournier
2012/0091917 A1 4/2012 Vinther et al.
2012/0139426 A1 6/2012 Ilyes et al.
2012/0243213 A1 9/2012 Chen
2013/0039055 A1 2/2013 Wilson et al.
2013/0088152 A1 4/2013 Hagen
2013/0114253 A1 5/2013 Segawa et al.
2013/0162139 A1 6/2013 Liu
2013/0208489 A1 8/2013 Schmuckle
2013/0221872 A1 8/2013 Gan et al.
2013/0249437 A1 9/2013 Wang et al.
2013/0331657 A1 12/2013 Basson et al.
2014/0022794 A1 1/2014 Laukkanen
2014/0092593 A1 4/2014 Gordin et al.
2014/0049967 A1 5/2014 Beausoleil
2014/0119022 A1 5/2014 Beausoleil
2014/0198482 A1 7/2014 Yue
2014/0218902 A1 * 8/2014 Maglica ..... F21V 14/045 362/188
2014/0256163 A1 9/2014 Kuo
2014/0300285 A1 10/2014 Medak
2014/0334157 A1 11/2014 Ferguson
2014/0375203 A1 12/2014 Goscha et al.
2015/0003050 A1 * 1/2015 Parsons ..... H05B 45/3725 362/158
2015/0028776 A1 1/2015 Mcmillan
2015/0129398 A1 5/2015 Wilkins et al.
2015/0131282 A1 5/2015 Best et al.
2015/0131288 A1 5/2015 Zhang
2015/0153025 A1 6/2015 Wu
2015/0167953 A1 6/2015 Huang
2015/0212263 A1 7/2015 Tzeng
2015/0159852 A1 9/2015 Brynjolfsson
2015/0260385 A1 9/2015 Brynjolfsson
2015/0345733 A1 12/2015 Bobbo et al.
2016/0123563 A1 5/2016 Ferguson et al.
2016/0153619 A1 6/2016 Frohnapfel
2016/0375163 A1 12/2016 Hawkins et al.
2016/0377280 A1 12/2016 Acampora et al.
2017/0085027 A1 3/2017 Ishaug et al.
2017/0108204 A1 4/2017 Wu
2017/0167695 A1 6/2017 Erdener
2017/0167718 A1 6/2017 Erdener et al.
2017/0171929 A1 6/2017 Erdener et al.
2017/0171932 A1 6/2017 Puvanakijjakorn
2017/0175963 A1 6/2017 Lentine et al.
2017/0219188 A1 8/2017 Veloskey
2017/0325311 A1 11/2017 Athalye
2018/0017239 A1 1/2018 Liu et al.
2018/0031215 A1 2/2018 Erdener et al.
2018/0156423 A1 6/2018 Murby
2018/0156445 A1 6/2018 Chen
2019/0264899 A1 8/2019 Erdener
2020/0063951 A1 2/2020 Yu et al.
2020/0173630 A1 6/2020 Zhang
2021/0247038 A1 8/2021 Zhang
2021/0356110 A1 11/2021 Zhang
2021/0396362 A1 12/2021 Zhang et al.

FOREIGN PATENT DOCUMENTS

CN 200996560 12/2007
CN 201428965 3/2010
CN 101832493 9/2010
CN 201651985 11/2010
CN 201661934 12/2010
CN 201697032 1/2011
CN 201795292 U 4/2011
CN 201868044 6/2011
CN 202001978 10/2011
CN 202132720 U 2/2012
CN 102537788 7/2012
CN 102818171 12/2012
CN 202617421 12/2012
CN 202993068 6/2013
CN 203099444 7/2013
CN 203099944 7/2013
CN 203115737 8/2013
CN 203131451 U 8/2013
CN 203215414 9/2013
CN 103335219 10/2013
CN 203223756 U 10/2013
CN 203225915 10/2013
CN 203375353 1/2014
CN 203573985 4/2014
CN 303021758 12/2014
CN 104315460 1/2015
CN 104595757 5/2015
CN 204313074 5/2015
CN 105114878 12/2015

(56) References Cited

FOREIGN PATENT DOCUMENTS

| | | | |
|---|---|---|---|
| CN | 204973611 | U | 1/2016 |
| CN | 105526521 | | 4/2016 |
| CN | 105889771 | | 8/2016 |
| CN | 205979248 | | 2/2017 |
| CN | 206207184 | U | 5/2017 |
| CN | 206817297 | U | 12/2017 |
| CN | 207486634 | | 6/2018 |
| CN | 109140397 | | 1/2019 |
| CN | 109578834 | A | 4/2019 |
| CN | 110056825 | A | 7/2019 |
| CN | 110332485 | A | 10/2019 |
| CN | 209587772 | U | 11/2019 |
| CN | 209726016 | U | 12/2019 |
| CN | 209762834 | U | 12/2019 |
| CN | 210319700 | U | 4/2020 |
| DE | 19620209 | | 11/1997 |
| DE | 10006410 | | 8/2001 |
| DE | 202006006481 | | 6/2006 |
| DE | 202014008377 | | 10/2014 |
| EP | 1034690 | | 10/2003 |
| EP | 0929993 | | 10/2004 |
| GB | 2418979 | | 4/2006 |
| GB | 2523802 | | 9/2015 |
| HK | 1198615 | | 4/2015 |
| JP | 3673943 | | 7/2005 |
| JP | 3875392 | | 1/2007 |
| JP | 4590283 | | 12/2010 |
| JP | 2011165394 | | 8/2011 |
| JP | 2012014980 | | 1/2012 |
| JP | 4894688 | | 3/2012 |
| JP | 5124978 | | 1/2013 |
| JP | 5354209 | | 11/2013 |
| JP | 2013254665 | | 12/2013 |
| JP | 2014157795 | | 8/2014 |
| JP | 2015076304 | | 4/2015 |
| JP | 6182417 | | 8/2017 |
| JP | 6473927 | | 2/2019 |
| KR | 20120135003 | | 12/2012 |
| KR | 101420351 | | 7/2014 |
| KR | 20150009880 | | 1/2015 |
| KR | 20150021814 | | 3/2015 |
| KR | 101676019 | | 11/2016 |
| KR | 101677730 | | 11/2016 |
| KR | 101937643 | | 1/2019 |
| KR | 101957884 | | 3/2019 |
| RU | 2358354 | | 6/2009 |
| TW | 330233 | | 4/1998 |
| TW | M295720 | | 8/2006 |
| TW | 201205901 | | 2/2012 |
| TW | I391600 | | 4/2013 |
| TW | M481324 | | 7/2014 |
| WO | 2002084750 | | 10/2002 |
| WO | 2008049405 | | 5/2008 |
| WO | 2010021675 | | 2/2010 |
| WO | 2011143510 | | 11/2011 |
| WO | 2013021940 | | 2/2013 |
| WO | 2013024557 | | 2/2013 |
| WO | 2011065047 | | 4/2013 |
| WO | 2013184166 | | 12/2013 |
| WO | 2014108870 | | 7/2014 |
| WO | 2015070150 | | 5/2015 |
| WO | 2015162600 | | 10/2015 |
| WO | 2019100448 | | 5/2019 |
| WO | 2021134806 | | 7/2021 |
| WO | 2021212541 | | 10/2021 |

OTHER PUBLICATIONS

Article labeled: "Philips CP5 Concrete Pour Kit ("CP5")", Low Voltage Inground Lighting; On sale, described in a printed publication, and/or in public use at least as early as 2011, 1 pg.

HADCO; Installation Instructions: CP2, CP3, CP4 & CP5 Accessories, Copyright 2018, 2 pgs.

Keeping, Steven; Article entitled: "LED Packaging and Efficacy Advances Boost Lumen Density", located at <https://www.digikey.com/en/articles/led-packaging-and-efficacy-advances-boost-lumen-density>, published on Jan. 14, 2014, 5 pgs.

Keeping, Steven; Article entitled: "The Rise of Chip-on-Board LED Modules", located at <https://www.digikey.com/en/articles/the-rise-of-chip-on-board-led-modules>, published on Mar. 11, 2014, 5 pgs.

LEDs Magazine; Article entitled: "Controlling LED lighting systems: introducing the LED Driver", located at <https://www.ledsmagazine.com/architectural-lighting/retail-hospitality/article/16701402/controlling-led-lighting-systems-introducing-the-led-driver>, published Dec. 10, 2004, 11 pgs.

Linear Artwork, Inc.; Brochure or LA8303 Driver, published Jun. 11, 2009, 20 pgs.

NKK Switches; Design Guide for the '90s, Catalog No. 9405, Published Jan. 1994, 21 pgs.

NNO Innotech Co. Ltd; LA8303 Driver Specification, published Mar. 7, 2013, 20 pgs.

Philips Hadco; Brochure for FlexScape LED, Published 2015, 12 pgs.

Philips Landscape; Brochure for Luminaire Smart Service Guide, published Oct. 2014, 28 pgs.

Philips; Brochure for "BL9 Flexscape LED Accent Landscape Luminaire", Copyright 2014, 3 pgs.

Philips; Installation Instructions IL9 Inground, Copyright 2014, 2 pgs.

Philips; Installation Instructions: BL9 Accent, Copyright 2014, 4 pgs.

Pratt, Charles, Encyclopedia of Electronic Components vol. 1, Copyright 2013, 302 pgs.

Pratt, Charles, Encyclopedia of Electronic Components vol. 2, Copyright 2015, 316 pgs.

Spectrol Electronics Corporation; Spectral Short Form Catalog, Copyright 1966, 13 pgs.

Zhang, Haicheng; Notice of Allowance for U.S. Appl. No. 16/645,458, filed Jan. 25, 2021, dated Jun. 16, 2021, 14 pgs.

Zhang, Haicheng; Notice of Allowance for U.S. Appl. No. 16/645,458, filed Jan. 25, 2021, dated Sep. 27, 2021, 42 pgs.

Zhang, Haicheng; Non-Final Office Action for U.S. Appl. No. 16/086,562, filed Sep. 19, 2018, dated Mar. 18, 2020, 12 pgs.

Zhang, Haicheng; Notice of Allowance for U.S. Appl. No. 16/086,562, filed Sep. 19, 2018, dated Jul. 8, 2020, 8 pgs.

Haicheng, Zhang; Office Action for Chinese patent application No. 201911420142.2, filed Dec. 31, 2019, dated May 20, 2020, 9 pgs.

Zhang, Haicheng; International Search Report and Written Opinion for PCT/CN2020/070502, filed Jan. 6, 2020, dated Aug. 27, 2020, 8 pgs.

Zhang, Haicheng; International Search Report and Written Opinion for PCT/CN2020/088127, filed Apr. 30, 2020, dated Jan. 4, 2021, 8 pgs.

Zhang, Haicheng; International Preliminary Report on Patentability for PCT/CN2017/115006, filed Dec. 7, 2017, dated May 26, 2020, 9 pgs.

Zhang, Haicheng; International Search Report and Written Opinion for PCT/CN2017/115006, filed Dec. 7, 2017, dated Aug. 17, 2018, 14 pgs.

Zhang, Haicheng; Non-Final Office Action for U.S. Appl. No. 17/463,086, filed Aug. 31, 2021, dated Feb. 15, 2022, 61 pgs.

Zhang, Haicheng; Non-Final Office Action for U.S. Appl. No. 17/389,019, filed Jul. 29, 2021, dated Feb. 15, 2022, 65 pgs.

Haicheng, Zhang; Search Report for Chinese patent application No. 201911420142.2, filed Dec. 31, 2019, dated May 12, 2020, 2 pgs.

Zhang, Haicheng; Notice of Allowance for U.S. Appl. No. 17/463,086, filed Aug. 31, 2021, dated Jun. 2, 2022, 20 pgs.

* cited by examiner

SPOTLIGHT STRUCTURE

CROSS REFERENCE TO THE RELATED APPLICATIONS

This application is the national phase entry of International Application PCT/CN2020/088127, filed on Apr. 30, 2020, which is based upon and claims priority to Chinese Patent Application No. 202010325182.5, filed on Apr. 23, 2020, the entire contents of which are incorporated herein by reference.

TECHNICAL FIELD

The present invention belongs to the technical field of light-emitting diode (LED) light, and more specifically, relates to a spotlight structure.

BACKGROUND

An outdoor spotlight is typically used to draw attention to key areas of outdoor building structures and landscaping, including trees, plants, architectural signs, artificial mountains, stones, signage and the like. In the key outdoor areas to be highlighted, the features of different objects be lit using spotlights of different sizes, different color temperatures and different brightness. Different object sizes, shapes and areas of emphasis also influence the selection of spotlight features. Current spotlights typically have an adjusting device on the outer wall. Such exterior structures, however, are usually not water resistant. As a result, rainwater often seeps into the spotlights and causes lighting failure. It is, therefore, highly desirable to design an outdoor spotlight that is waterproof, brightness-adjustable, has color temperature-adjustable and spot size-adjustable.

SUMMARY

The technical problem to be solved by the present invention is that the brightness-adjustable, color temperature-adjustable and spot-adjustable spotlights in the prior art have poor water resistance and water may easily seep therein.

The present invention adopts the following technical solution. A spotlight structure includes a main body, a waterproof front cover and a waterproof rear cover. Screw threads are arranged on the outer wall of the front end of the main body and the outer wall of the rear end of the main body, and a dovetail groove is arranged at the root of the screw thread. An O-ring is sleeved on the dovetail groove. An edge of the waterproof front cover next to the O-ring and an edge of the waterproof rear cover next to the O-ring are a beveled edge, respectively. The waterproof front cover is connected to the front end of the main body by the screw thread, and the waterproof rear cover is connected to the rear end of the main body by the screw thread.

Preferably, a brightness adjusting component, a color temperature adjusting component, and a spotlight adjusting component are built into the front cavity and the rear cavity of the main body. The front end and the rear end of the main body are respectively provided with a screw tooth, and the front cover and the rear cover are connected to the main body by the spiral structure. A rubber gasket is compressed to seal the front cavity and the rear cavity of the main body, respectively. When the cover is unscrewed, users can easily adjust the brightness, color temperature, and spotlight size.

When the cover is securely screwed into place, the three components are hermetically enclosed in the waterproof main body.

Preferably, the outer wall of the front cover and the outer wall of the rear cover are provided with a knurling, respectively.

An oblique-opening cover is arranged on one end of the front cover and one end of the rear end, respectively.

The other end of the front cover is provided with a U-shaped groove near the edge. A transparent body is stuck to the front cover by filling an adhesive in the U-shaped groove.

The other end of the rear cover is sealed and is shaped as a bowl-shaped housing.

Preferably, the main body is provided with an inner cavity. A bulkhead is arranged in the inner cavity, and the bulkhead divides the inner cavity into the front cavity and the rear cavity. A spotlight adjusting component is arranged in the front cavity, and a color temperature adjusting component is arranged in the rear cavity.

Preferably, the spotlight adjusting component includes:

a light source bracket, wherein, the light source bracket is fixed to the bottom wall of the front cavity by the screw, the light source bracket presses a luminous body against the bottom wall of the front cavity; three lug bosses are arranged on the light source bracket in a circumferential direction, and a convex rib is arranged at an upper portion and a lower portion of each lug boss;

a lens holder, wherein, three oblique grooves are circumferentially arranged on the outer wall of the lens holder, and convex ribs are evenly distributed on the upper and lower sides of the oblique grooves; the lug boss is engaged into the oblique groove; a lens is installed on the lens holder; a honeycomb net and a color temperature filter are successively placed on the top of the lens; and a rotating cylinder, wherein, the rotating cylinder is engaged into the lens holder.

Preferably, the color temperature adjusting component includes:

a plastic power supply box, wherein, the plastic power supply box is fixed on the inner wall of the rear cavity by a screw; one end of the plastic power supply box is provided with an intelligent control power supply, and two electronic leads of the luminous body are connected to the output terminal of the intelligent control power supply;

a square groove, wherein, the square groove is arranged on the side wall of the main body; a waist-shaped hole and a threaded hole are arranged on the bottom of the square groove; an adapter block is arranged in the square groove, and the adapter block is fixed in the square groove by a bolt; and a rotating arm, wherein, one end of the rotating arm is engaged with the adapter block, the other end of the rotating arm is provided with a screw thread, and the rotating arm can be fixedly connected to a fixed base by the screw thread; the input lead of the intelligent control power supply passes out of the side wall of the main body, successively through the adapter block and the rotating arm, and is then connected to a wire.

Preferably, a dimming button and a color temperature adjusting button are arranged on the intelligent control power supply, respectively.

Preferably, the outer wall of the front cover and the outer wall of the rear cover are provided with the knurling.

Preferably, the oblique-opening cover is arranged on one end of the front cover and one end of the rear cover.

The other end of the front cover is provided with the U-shaped groove near the edge. The transparent body is stuck to the front cover by filling the adhesive in the U-shaped groove.

The other end of the rear cover is sealed and is shaped as the bowl-shaped housing.

Preferably, a cleaning device is arranged on the outer wall of the main body, and the cleaning device includes:

a housing, wherein, the housing is arranged on the outer wall of the main body, and the housing is shaped as a cylinder, the side wall of the housing is provided with an annular opening;

a bearing, wherein, the bearing is arranged in the housing, and the inner ring of the bearing is fixed to the outer wall of the main body;

a first bevel gear, wherein, a first through hole is arranged at the center of the first bevel gear, the inner wall of the first through hole is fixedly connected to the outer ring of the bearing, and the first bevel gear is rotated around the axis of the main body;

a sliding groove, wherein the sliding groove is arranged on the side wall of the first bevel gear; the sliding groove extends in the radial direction of the first bevel gear; a sliding block is arranged in the sliding groove, and the sliding block can move back and forth along the sliding groove; an engaged strip is arranged on the side wall of the sliding block; the inner wall of the sliding groove is provided with a guide groove, and the engaged strip is engaged into the guide groove;

a guide rod, wherein, the guide rod is arranged under the sliding groove; one end of the guide rod is connected to the side wall of the first bevel gear, and the other end of the guide rod passes through the annular opening and extends out of the housing;

a cleaning ring, wherein, the cleaning ring is sleeved on the outer wall of the main body; the side wall of the cleaning ring is provided with a second through hole extending in the axial direction; the end of the guide rod away from the first bevel gear passes through the second through hole and is connected to a stop block; a bristle is arranged on the inner wall of the cleaning ring;

a spring, wherein, the spring is sleeved on the guide rod; one end of the spring is connected to the side wall of the first bevel gear, and the other end of the spring is connected to the cleaning ring; and a connecting rod, wherein, one end of the connecting rod is hinged to the sliding block, and the other end of the connecting rod is hinged to the outer wall of the cleaning ring.

Preferably, the cleaning device further includes a motor, wherein, the motor is arranged on the outer wall of the main body. The motor is located in the housing, and the output shaft of the motor extends outwards and is connected to a second bevel gear. The first bevel gear is engaged with the second bevel gear.

Preferably, a cleaning solution spraying device is further provided, and the cleaning solution spraying device includes:

a fluid storage tank, wherein, the fluid storage tank is arranged at the upper end of the housing, and a cleaning solution is provided in the fluid storage tank;

a plurality of third through holes, wherein, the plurality of third through holes are provided on the outer wall of the main body in the circumferential direction, and the cleaning ring covers on the third through hole;

a spray head, wherein, the spray head is arranged on the stop block, and the nozzle of the spray head faces toward the third through hole;

a connecting pipe, wherein, one end of the connecting pipe is connected to the bottom of the fluid storage tank, and the other end of the connecting pipe is connected to the spray head; a pressure pump and a solenoid valve are successively arranged on the connecting pipe; a processor is arranged in the housing, and the processor is connected to the motor, the pressure pump and the solenoid valve, respectively; the processor is wirelessly communicated with a mobile terminal; and a fluid intake pipe, wherein the fluid intake pipe is arranged on the top of the fluid storage tank, and a cover is arranged on the upper end of the fluid intake pipe.

The present invention has the following advantages. A spotlight structure includes a main body, a waterproof front cover, and a waterproof rear cover. A screw thread is arranged on the outer wall of the front end of the main body and the outer wall of the rear end of the main body, and a dovetail groove is arranged at the root of the screw thread. An O-ring is sleeved on the dovetail groove. The edge of the waterproof front cover next to the O-ring and the edge of the waterproof rear cover next to the O-ring are a beveled edge, respectively. The waterproof front cover is threaded with the front end of the main body, and the waterproof rear cover is threaded with the rear end of the main body. When the rotating cylinder, the dimming button, and the color temperature adjusting button are not adjusted, they are sealed by the waterproof front cover and the waterproof rear cover. Therefore, water seepage into the inner cavities is prevented thus improving the service life of the spotlight.

The other features and advantages of the present invention will be described subsequently in conjunction with the embodiments, and become partially clear, or be understood by the implementation of the present invention. The purpose and other advantages of the present invention can be implemented and obtained by the structure specified in the description and the drawings.

The technical solution of the present invention is further described in detail hereinafter with reference to the drawings and the embodiments.

BRIEF DESCRIPTION OF THE DRAWINGS

The drawings are used to provide a further understanding of the present invention and form part of the specification, and the drawings are used together with the embodiments of the present invention to describe the present invention but do not constitute a limitation to the present invention. In the drawings.

Figure 1:
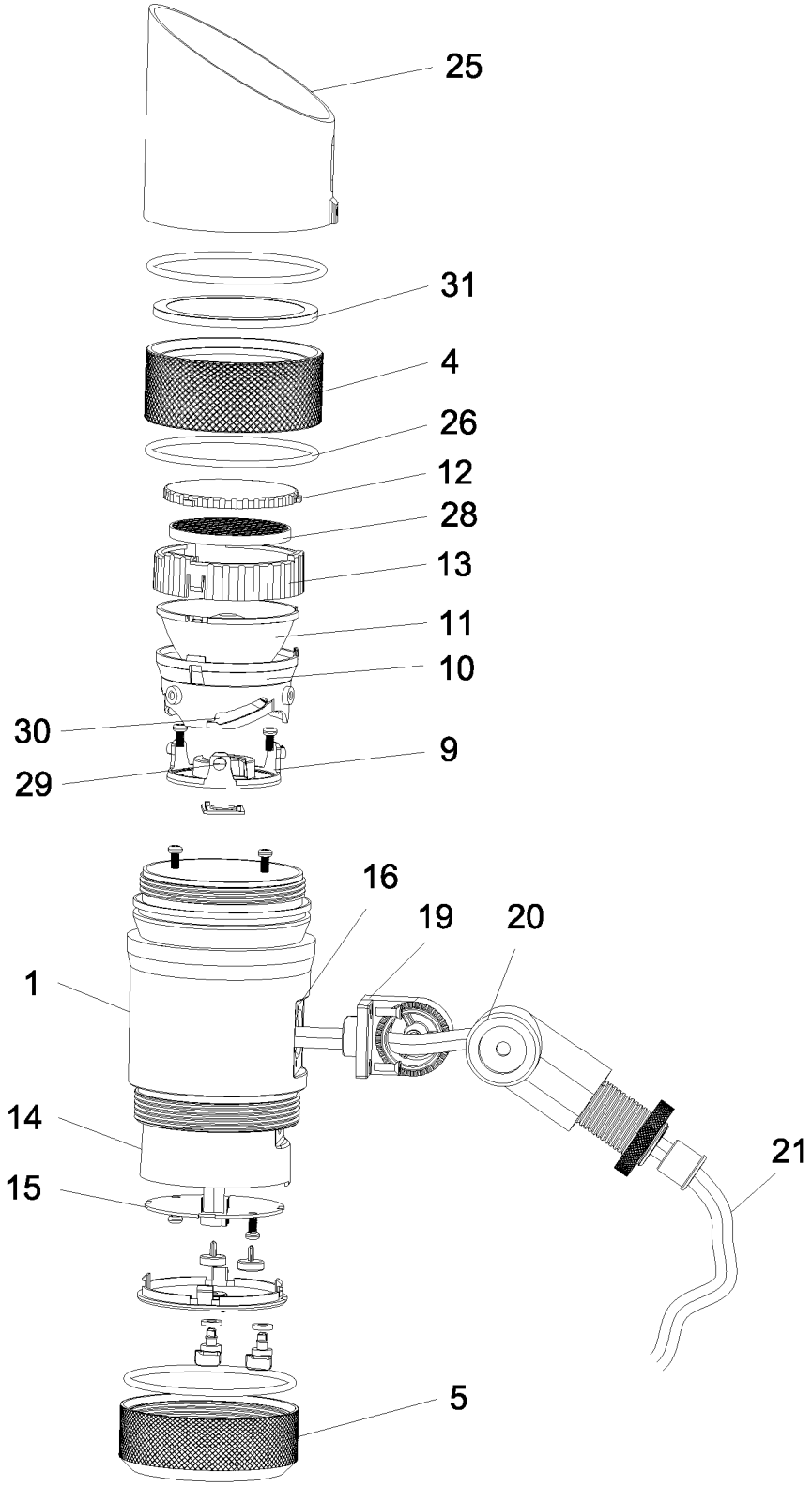
FIG. 1 is a schematic diagram showing the structure of the present invention.
Figure 2:
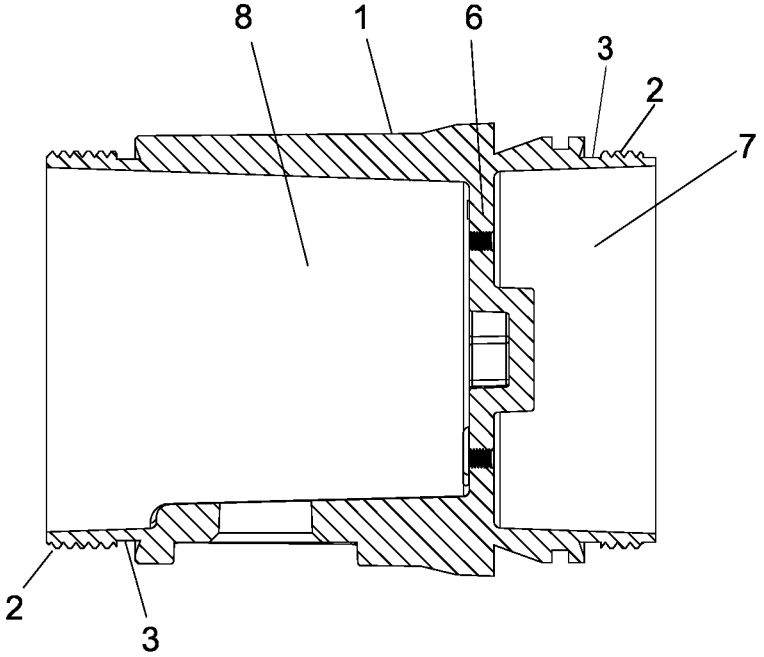
FIG. 2 is a schematic diagram showing the structure of a main body of the present invention.
Figure 3:
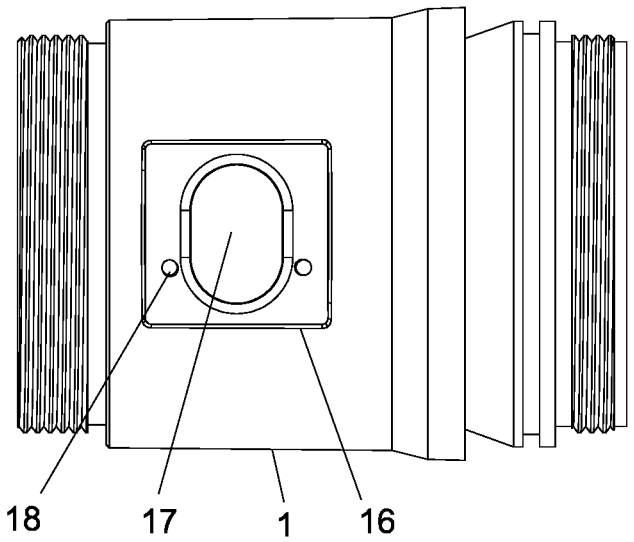
FIG. 3 is a schematic diagram showing the structure of a square groove of the present invention.
Figure 4:
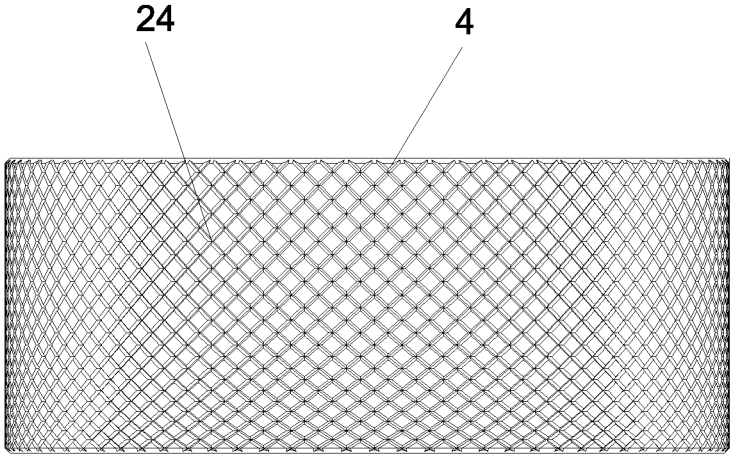
FIG. 4 is a schematic diagram showing the external of a waterproof front cover in the present invention.
Figure 5:
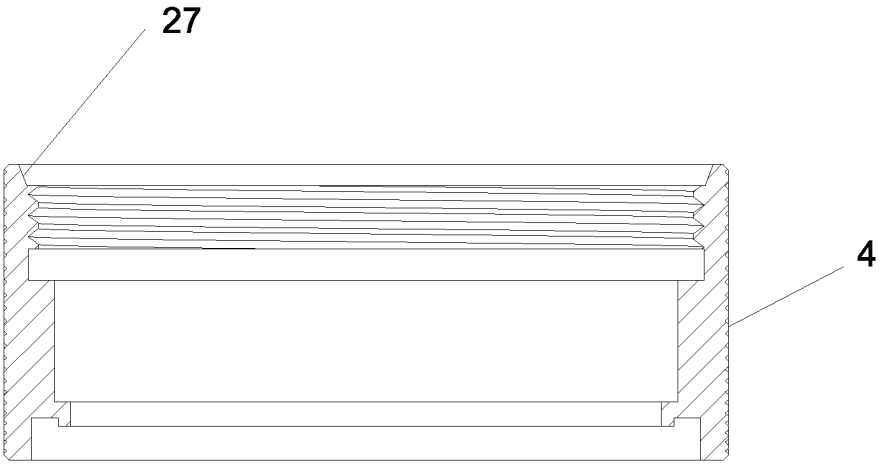
FIG. 5 is a schematic diagram showing the interior structure of the waterproof front cover in the present invention.
Figure 6:
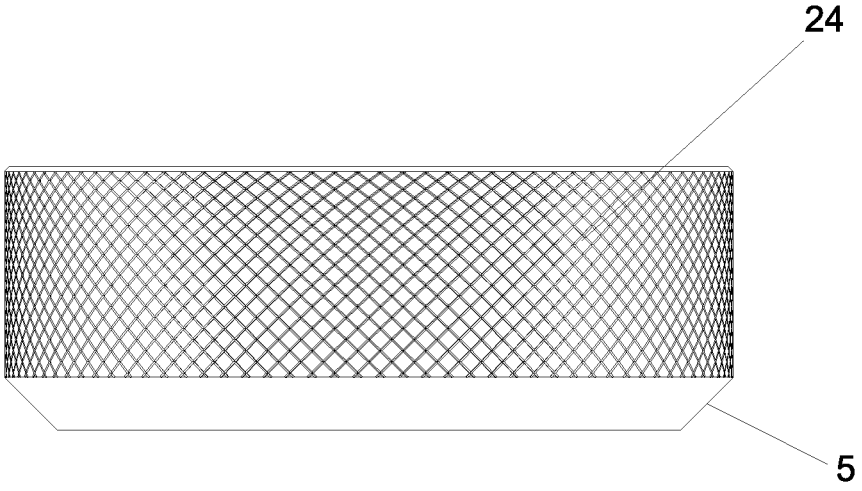
FIG. 6 is a schematic diagram showing the external of a waterproof rear cover in the present invention.
Figure 7:
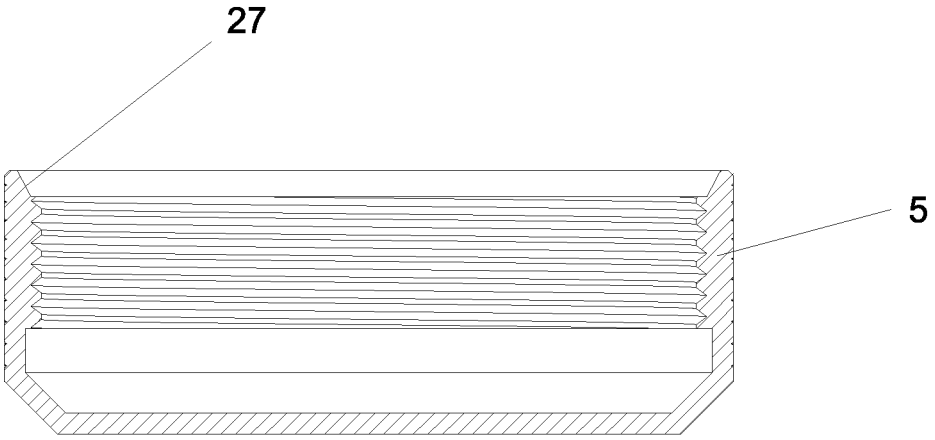
FIG. 7 is a schematic diagram showing the interior structure of the waterproof rear cover in the present invention.

In the figures: 1—main body, 2—screw thread, 3—dovetail groove, 4—waterproof front cover, 5—waterproof rear cover, 6—bulkhead, 7—front cavity, 8—rear cavity, 9—light source bracket, 10—lens holder, 11—lens, 12—color filter, 13—rotating cylinder, 14—plastic power supply box, 15—intelligent control power supply, 16—square groove, 17—waist-shaped hole, 18—threaded hole, 19—adapter block, 20—rotating arm, 21—wire, 22—dimming button, 23—color temperature adjusting button, 24—knurling, 25—oblique-opening cover, 26—O-shaped ring, 27—oblique edge, 28—honeycomb net, 29—lug boss, 30—oblique groove, 31—transparent body, 32—housing, 33—bearing, 34—first bevel gear, 35—sliding groove, 36—sliding block, 37—annular opening, 38—guide rod, 39—cleaning ring, 40—second through hole, 41—stop block, 42—spring, 43—connecting rod, 44—engaged strip, 45—guide groove, 46—motor, 47—second bevel gear, 48—fluid storage tank, 49—third through hole, 50—spray head, 51—connecting pipe, 52—pressure pump, 53—solenoid valve, 54—processor, 55—fluid intake pipe, 56—cover.

DETAILED DESCRIPTION OF THE EMBODIMENTS

The preferred embodiments of the present invention are described hereinafter in conjunction with the drawings, it should be noted that the preferred embodiments described herein are only for the purpose of illustration and interpretation of the present invention and shall not limit the present invention.

The embodiment of the present invention provides a spotlight structure, including the main body 1, the waterproof front cover 4, and the waterproof rear cover 5. The screw thread 2 is arranged on the outer wall of the front end of the main body 1 and the outer wall of the rear end of the main body 1. The dovetail groove 3 is arranged at the root of the screw thread 2 and the O-ring 26 is sleeved on the dovetail groove 3. The edge of the waterproof front cover 4 adjacent to the O-ring 26 and the edge of the waterproof rear cover 5 adjacent to the O-ring 26 are the beveled edge 27, respectively. The waterproof front cover 4 is threaded with the front end of the main body 1, and the waterproof rear cover 5 is threaded with the rear end of the main body 1. The waterproof front cover 4 and the waterproof rear cover 5 are bowl-shaped.

The principle and advantages of the above technical solution are as follows. The waterproof front cover 4 and the waterproof rear cover 5 are respectively installed on the front end and the rear end of the main body 1 by means of the screw thread 2. During the screwing process, the waterproof rear cover 5 causes the O-ring 26 to squeeze inward along the dovetail groove 3 of the main body 1, to form a water-tight seal at the rear end. Since the edge of one end of the waterproof front cover 4 is the beveled edge 27, during the screwing process, the waterproof front cover 4 causes the O-ring to squeeze inward along the dovetail groove 3 of the main body 1 to achieve a waterproof seal at the front end.

In an embodiment, the main body 1 is provided with the inner cavity, and the bulkhead 6 is arranged in the inner cavity. The bulkhead 6 divides the inner cavity into the front cavity 7 and the rear cavity 8. The spotlight adjusting component is arranged in the front cavity 7, and the color temperature adjusting component is arranged in the rear cavity 8.

The spotlight adjusting component includes:

the light source bracket 9, wherein the light source bracket 9 is fixed to the bottom wall of the front cavity 7 by the screw, the light source bracket 9 presses the luminous body against the bottom wall of the front cavity 7, three lug bosses 29 are arranged on the light source bracket 9 in the circumferential direction;

the lens holder 10, wherein, three oblique grooves 30 are arranged on the outer wall of the lens holder 10 in the circumferential direction; the lug boss 29 is engaged into the oblique groove 30; the lens 11 is installed on the lens holder 10; the honeycomb net 28 and the color filter 12 are placed on the top of the lens 11 in sequence; the lens holder is provided with the upwardly tilted waist-shaped sliding grooves; the convex rib is arranged in the sliding groove to increase the damping during rotation, making the operation better; and the rotating cylinder 13, wherein the rotating cylinder 13 is engaged into the lens holder 10.

Figure 8:
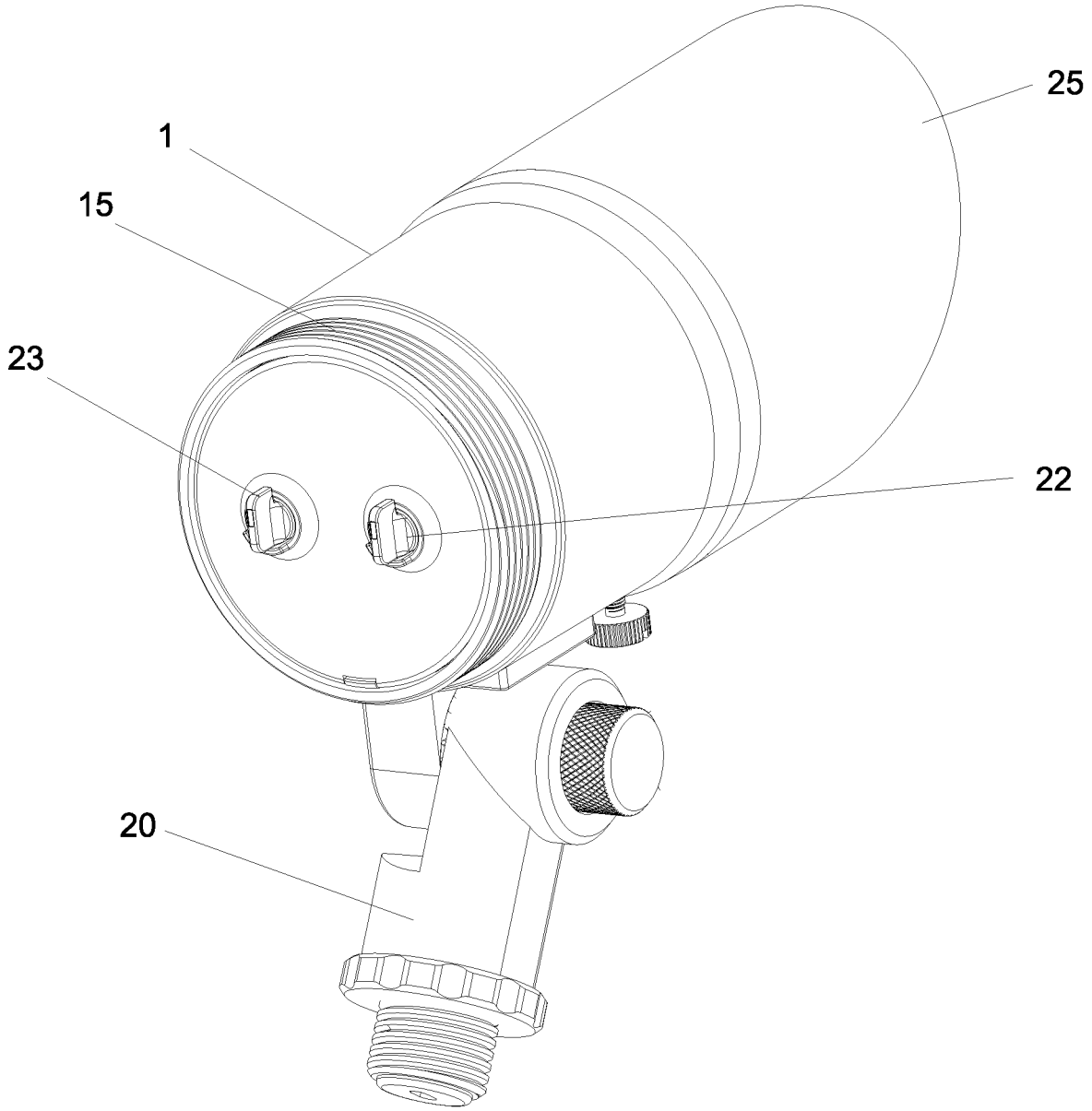
FIG. 8 is a schematic diagram showing the structures of a dimming button and a color temperature adjusting button in the present invention.

The color temperature adjusting component includes:

the plastic power supply box 14, wherein, the plastic power supply box 14 is fixed on the inner wall of the rear cavity 8 by the screwing; one end of the plastic power supply box 14 is provided with the intelligent control power supply 15, and two electronic leads of the luminous body are connected to the output terminal of the intelligent control power supply 15;

the square groove 16, wherein the square groove 16 is arranged on the side wall of the main body 1; the waist-shaped hole 17 and the threaded hole 18 are arranged on the bottom of the square groove 16; the adapter block 19 is arranged in the square groove 16; the adapter block 19 is fixed in the square groove 16 by the bolt; and the rotating arm 20, wherein, one end of the rotating arm 20 is engaged with the adapter block 19, the other end of the rotating arm 20 is provided with the screw thread, and the rotating arm 20 can be fixedly connected to the fixed base by the screw thread; the input lead of the intelligent control power supply 15 passes out of the side wall of the main body 1, successively through the adapter block 19 and the rotating arm 20, and is then connected to the wire 21; as shown in FIG. 8, the intelligent control power supply 15 is provided with the dimming button 22 and the color temperature adjusting button 23, respectively; the control power supply is fixed to the plastic power supply box by the screw, and the rotating arm is fixed to the adapter block by the screw, and then the mixed AB adhesive is filled into the power supply box. The adhesive is filled in the main body, the power supply box and the intelligent control power supply, and seals the outlet hole in waterproof fashion.

The principle and advantages of the above technical solution are as follows. When the size of the spotlight needs to be adjusted, the waterproof front cover 4 is unscrewed, the rotating cylinder 13 is manually rotated to turn the lens holder 10 and the lens 11. The lug boss 29 moves along the oblique groove 30, so that the rotating cylinder 13 rotates clockwise and the lens 11 moves away from the luminous body, thereby decreasing the size of the spotlight; when the rotating cylinder 13 rotates counterclockwise, the lens 11 moves closer to the luminous body, thereby increasing the size of the spotlight. After the adjustment of the spotlight, the waterproof front cover 4 is screwed so that the O-ring is pressed into the dovetail groove of the main body 1 to achieve sealing, thereby preventing water from entering the cavity. During rotation, the convex rib on the lug boss 29 and the convex rib on the oblique groove 30 create a damping effect on each other, making the angle adjustment tactile. When the brightness and the color temperature need to be adjusted, the waterproof rear cover 5 is unscrewed, the dimming button 22 is rotated to adjust the brightness, and the color temperature adjusting button 23 is rotated to adjust the color temperature. After adjustment, the waterproof rear cover 5 is screwed so that the O-ring is pressed into the dovetail groove of the main body 1 to form a waterproof seal preventing water from entering the cavity. The rotating cylinder, the dimming button and the color temperature adjusting button, when not adjusted, are sealed by the waterproof front cover and the waterproof rear cover. Therefore, it is not easy to contact with water to cause failure, thereby improving the service life of the spotlight.

In an embodiment, as shown in FIGS. 4-7, the outer wall of the waterproof front cover 4 and the outer wall of the waterproof rear cover 5 are provided with the knurling 24.

The principle and advantage of the above technical solution are as follows. The knurling 24 arranged on the external surface increases friction, facilitating disassembly and assembly.

In an embodiment, as shown in FIG. 1, the oblique-opening cover 25 is arranged on the waterproof front cover 4.

The principle and advantage of the above technical solution are follows. The oblique-opening cover 25 is sleeved on the front end of the spotlight to adjust the projection direction of the light. The bottom of the oblique-opening cover 25 is provided with the screw tooth and is fixed by the screw manually. The transparent body 31 is arranged between the oblique-opening cover 25 and the waterproof front cover 4, and the transparent body 31 is made of glass.

Figure 9:
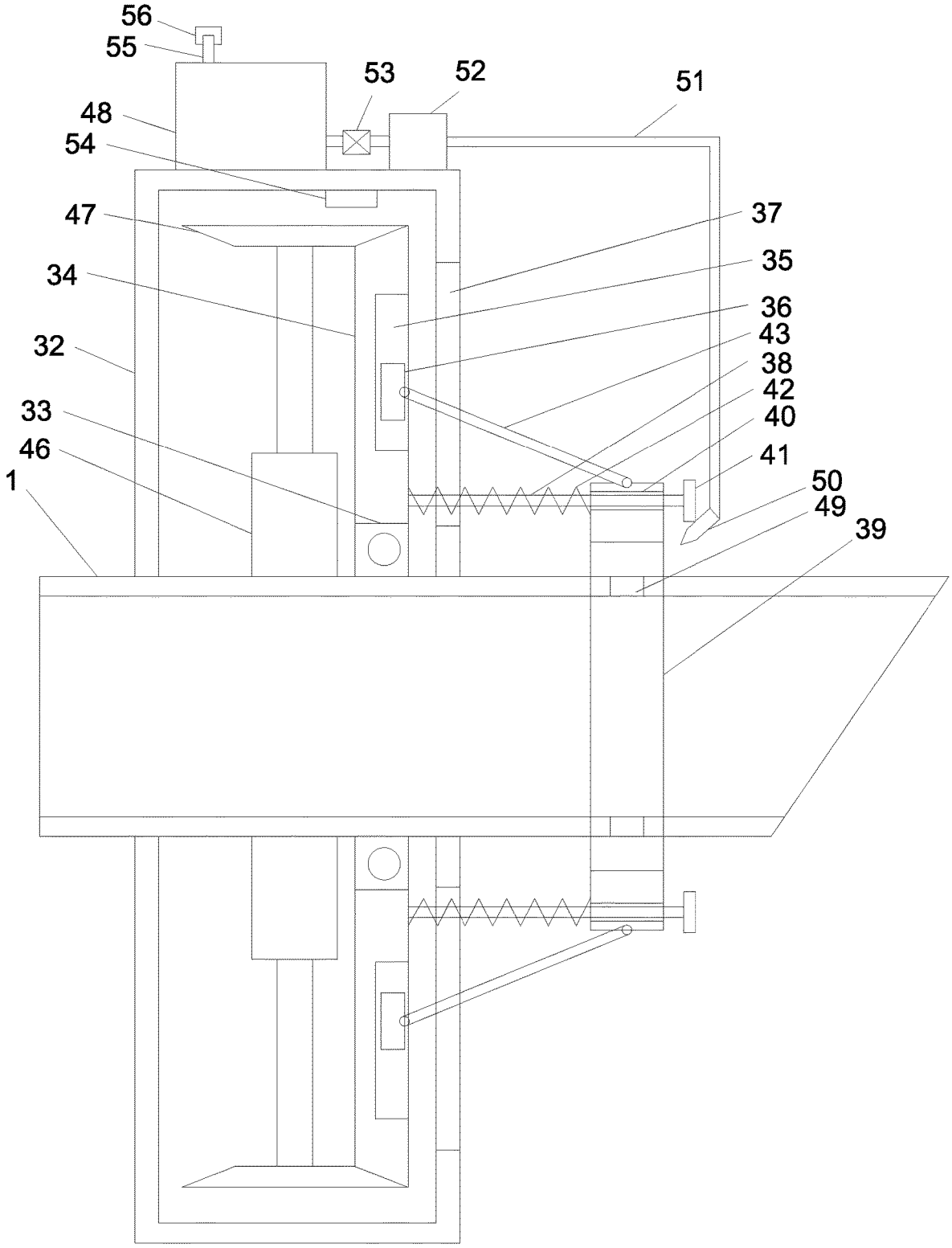
FIG. 9 is a schematic diagram showing the structure of a cleaning device in the present invention.
Figure 10:
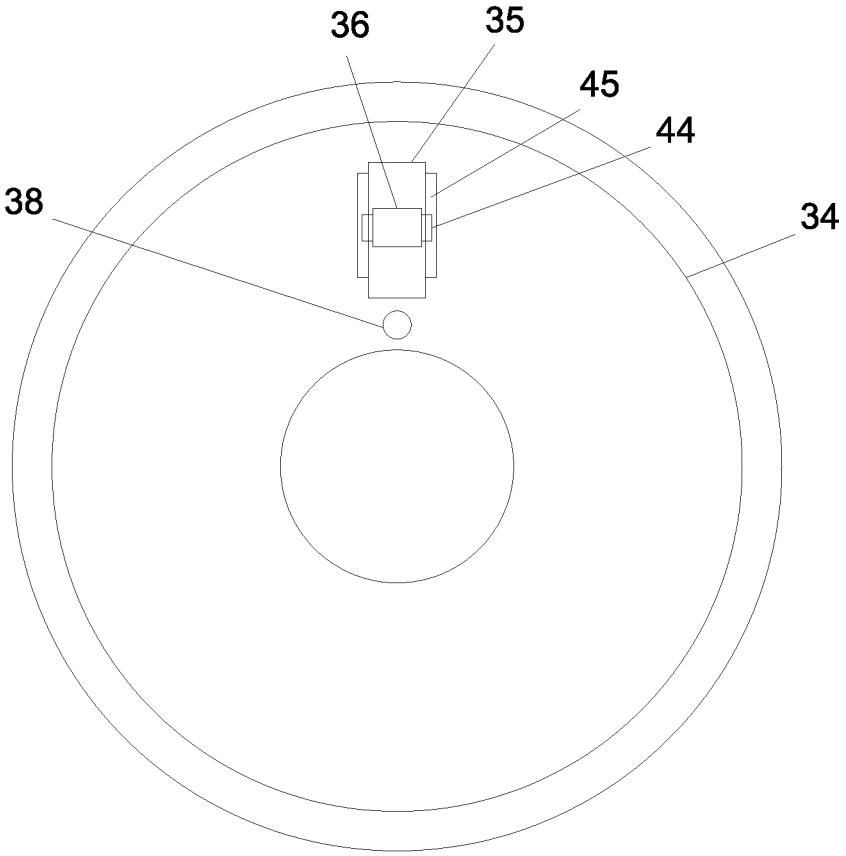
FIG. 10 is a schematic diagram showing the structure of a first bevel gear in the present invention.
Figure 11:
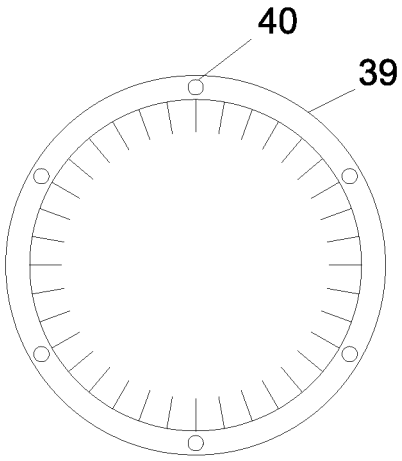
FIG. 11 is a schematic diagram showing the structure of a cleaning ring in the present invention.

In an embodiment, as shown in FIGS. 9-11, the cleaning device is arranged on the outer wall of the main body 1. The cleaning device includes:

the housing 32, wherein the housing 32 is arranged on the outer wall of the main body 1, and the housing 32 is shaped as a cylinder, and the side wall of the housing 32 is provided with the annular opening 37;

the bearing 33, wherein the bearing 33 is arranged in the housing 32, and the inner ring of the bearing 33 is fixed to the outer wall of the main body 1;

the first bevel gear 34, wherein a first through hole is arranged at the center of the first bevel gear 34, the inner wall of the first through hole is fixedly connected to the outer ring of the bearing 33, and the first bevel gear 34 can rotate around the axis of the main body 1;

the sliding groove 35, wherein, the sliding groove 35 is arranged on the side wall of the first bevel gear 34; the sliding groove 35 extends in the radial direction of the first bevel gear 34; the sliding block 36 is arranged in the sliding groove 35, and the sliding block 36 can move back and forth along the sliding groove 35; the engaged strip 44 is arranged at the side wall of the sliding block 36; the guide groove 45 is arranged at the inner wall of the sliding groove 35, and the engaged strip 44 is engaged into the guide groove 45;

the guide rod 38, wherein the guide rod 38 is arranged under the sliding groove 35; one end of the guide rod 38 is connected to the side wall of the first bevel gear 34, and the other end of the guide rod 38 passes through the annular opening 37 and extends out of the housing 32;

the cleaning ring 39, wherein the cleaning ring 39 is sleeved on the outer wall of the main body 1; the side wall of the cleaning ring 39 is provided with the second through hole 40 extending in the axial direction; the end of the guide rod 38 away from the first bevel gear 34 passes through the second through hole 40 and is connected to the stop block 41; the bristle is arranged on the inner wall of the cleaning ring 39;

the spring 42, wherein the spring 42 is sleeved on the guide rod 38; one end of the spring 42 is connected to the side wall of the first bevel gear 34, and the other end of the spring 42 is connected to the cleaning ring 39; and the connecting rod 43, wherein one end of the connecting rod 43 is hinged to the sliding block 36, and the other end of the connecting rod 43 is hinged to the outer wall of the cleaning ring 39.

The cleaning device further includes the motor 46, wherein the motor 46 is arranged on the outer wall of the main body 1. The motor 46 is located in the housing 32, and the output shaft of the motor 46 extends outwards and is connected to the second bevel gear 47. The first bevel gear 34 is engaged with the second bevel gear 47.

The principle and advantage of the above technical solution are as follows. When the outer wall of the spotlight needs to be cleaned, the motor 46 is activated to drive the second bevel gear 47 to rotate. Since the second bevel gear 47 is engaged with the first bevel gear 34, the second bevel gear 47 drives the first bevel gear 34 to rotate, and the sliding block 36 moves toward the outside of the sliding groove 35 under the action of the centrifugal force. Therefore, the connecting rod 43 drives the cleaning ring 39 to move left along the guide rod 38, and compress the spring 42. The centrifugal force is changed by the rotating speed of the motor 46, and thus the balance position of the cleaning ring 39 changes, and the cleaning ring 39 moves back and forth, right and left. Meanwhile, the cleaning ring 39 keeps rotating, so that the bristle on the inner wall of the cleaning ring 39 cleans the outer wall of the main body 1, removing dust from the outer wall of the main body 1.

In an embodiment, a cleaning solution spraying device is further provided. The cleaning solution spraying device includes:

the fluid storage tank 48, wherein, the fluid storage tank 48 is arranged at the upper end of the housing 32, and the cleaning solution is provided in the fluid storage tank 48;

a plurality of third through holes 49, wherein, the plurality of third through holes 49 are provided on the outer wall of the main body 1 in the circumferential direction, and the cleaning ring 39 covers on the third through hole 49;

the spray head 50, wherein, the spray head 50 is arranged on the stop block 41, and the nozzle of the spray head 50 faces toward the third through hole 49;

the connecting pipe 51, wherein, one end of the connecting pipe 51 is connected to the bottom of the fluid storage tank 48, and the other end of the connecting pipe 51 is connected to the spray head 50; the pressure pump 52 and the solenoid valve 53 are successively arranged on the connecting pipe 51; the processor 54 is arranged in the housing 32, and the the processor 54 is connected to the motor 46, the pressure pump 52 and the solenoid valve 53, respectively; the processor 54 is wirelessly communicated with the mobile terminal, and the mobile terminal is a mobile phone; and the fluid intake pipe 55, wherein, the fluid intake pipe 55 is arranged on the top of the fluid storage tank 48, and the cover 56 is arranged on the upper end of the fluid intake pipe 55.

The principle and advantage of the above technical solution area follows. During the cleaning process, the motor 46, the pressure pump 52 and the solenoid valve 53 are activated by the mobile phone, and the cleaning solution in the fluid storage tank 48 is delivered to the spray head 50 via the connecting pipe 51. When the cleaning ring 39 moves to the left end, the cleaning solution is sprayed onto the bristle, then the cleaning ring 39 moves to the right end to brush the outer wall of the main body 1. After the cleaning ring 39 moves away from the third through hole 49, the cleaning solution can be sprayed into the main body 1 via the third through hole 49 to wash and clean the transparent body 31 in the main body 1, thereby removing dust or dirt from the glass surface and avoiding affecting the brightness of the spotlight. When the cleaning device is stopped, the cleaning ring 39 is pushed to the left end under the elastic force of the spring 42, and the cleaning ring 39 covers the surface of the third through hole 49 to achieve sealing, preventing the entry of rainwater and dust.

Obviously, modifications and variations to the present invention can be made by those skilled in the art without departing from the spirit and scope of the present invention. Thus, if the modifications and variations of invention belong to the scope of the claims and the same technology of the present invention, such modifications and variations shall fall within the present invention.

What is claimed is:

1. A spotlight structure, comprising a main body, a waterproof front cover and a waterproof rear cover, wherein a first screw thread is provided on an outer wall of a front end of the main body, a second screw thread is provided on an outer wall of a rear end of the main body; a first groove is arranged at a root of the first screw thread; a second groove is arranged at a root of the second screw thread; a first O-shaped ring is sleeved on the first groove; a second O-shaped ring is sleeved on the second groove; an edge of the waterproof front cover adjacent to the first O-shaped ring is a first beveled edge; an edge of the waterproof rear cover adjacent to the second O-shaped ring is a second beveled edge; the waterproof front cover is threaded with the front end of the main body; the waterproof rear cover is threaded with the rear end of the main body; the main body is provided with an inner cavity, a bulkhead is arranged in the inner cavity, and the bulkhead divides the inner cavity into a front cavity and a rear cavity; a light spot adjusting component is arranged in the front cavity, and a color temperature adjusting component is arranged in the rear cavity; and the light spot adjusting component comprises:

a light source bracket, wherein, the light source bracket is fixed to a bottom wall of the front cavity; the light source bracket presses a luminous body against the bottom wall of the front cavity; three lug bosses are arranged on the light source bracket in a circumferential direction of the light source bracket;

a lens holder, wherein, three oblique grooves are arranged on an outer wall of the lens holder in a circumferential direction of the lens holder; the three lug bosses are engaged into the three oblique grooves; a lens is installed on the lens holder; a honeycomb net and a color filter are successively placed on a top of the lens; and a rotating cylinder, wherein, the rotating cylinder is engaged into the lens holder.

2. The spotlight structure according to claim 1, wherein, the color temperature adjusting component comprises:

a plastic power supply box, wherein, the plastic power supply box is fixed on an inner wall of the rear cavity; one end of the plastic power supply box is provided with a control power supply, and two electronic leads of the luminous body are connected to an output terminal of the control power supply;

a square groove, wherein, the square groove is arranged on a side wall of the main body; a waist-shaped hole and a threaded hole are arranged on a bottom of the square groove; an adapter block is arranged in the square groove, and the adapter block is fixed in the square groove by a bolt; and a rotating arm, wherein, a first end of the rotating arm is engaged with the adapter block, a second end of the rotating arm is provided with a screw thread, and the rotating arm is fixedly connected to a fixed base by the screw thread; an input lead of the control power supply passes out of the side wall of the main body, successively through the adapter block and the rotating arm secondly, and is then connected to a wire; the rotating arm is fixed to the adapter block, and an adhesive fill the main body to form a seal.

3. The spotlight structure according to claim 2, wherein, a dimming button and a color temperature adjusting button are arranged on the intelligent control power supply.

4. The spotlight structure according to claim 1, wherein, an outer wall of the waterproof front cover is provided with a first knurling and an outer wall of the waterproof rear cover is provided with a second knurling.

5. The spotlight structure according to claim 1, wherein, an oblique-opening cover is arranged on the waterproof front cover.

* * * * *